US007867056B2

(12) United States Patent
Scheininger et al.

(10) Patent No.: US 7,867,056 B2
(45) Date of Patent: Jan. 11, 2011

(54) BRA WINGS USING ELASTIC SPACER FABRIC

(75) Inventors: Manette Mallon Scheininger, Westfield, NJ (US); Steven Castellano, Middletown, NJ (US); Dean Gilliand, Ridgewood, NJ (US)

(73) Assignee: Maidenform, Inc., Iselin, NJ (US)

( * ) Notice: Subject to any disclaimer, the term of this patent is extended or adjusted under 35 U.S.C. 154(b) by 381 days.

(21) Appl. No.: 12/054,711

(22) Filed: Mar. 25, 2008

(65) Prior Publication Data

US 2008/0261490 A1 Oct. 23, 2008

Related U.S. Application Data

(60) Provisional application No. 60/913,381, filed on Apr. 23, 2007.

(51) Int. Cl.
*A41C 3/00* (2006.01)

(52) U.S. Cl. ..... 450/74; 450/75

(58) Field of Classification Search ..... 450/92, 450/93, 1, 74–76, 79; 442/304, 306, 308, 442/312; 66/19, 136, 170, 172, 196
See application file for complete search history.

(56) References Cited

U.S. PATENT DOCUMENTS 3,971,234 A * 7/1976 Taylor ..... 66/200
4,785,558 A * 11/1988 Shiomura ..... 36/114
4,787,219 A * 11/1988 Sato et al. ..... 66/190
5,284,031 A * 2/1994 Stoll et al. ..... 66/64
5,385,036 A * 1/1995 Spillane et al. ..... 66/87
5,395,684 A * 3/1995 Robinson et al. ..... 442/312
5,422,153 A * 6/1995 Miyamoto ..... 428/95
5,651,847 A * 7/1997 Loeffler ..... 66/19
5,735,145 A * 4/1998 Pernick ..... 66/196
5,896,758 A * 4/1999 Rock et al. ..... 66/191
6,105,401 A * 8/2000 Chadeyron et al. ..... 66/195
6,196,032 B1 * 3/2001 Rock et al. ..... 66/195
6,199,410 B1 * 3/2001 Rock et al. ..... 66/195
6,263,707 B1 * 7/2001 Miller et al. ..... 66/171
6,287,168 B1 * 9/2001 Rabinowicz ..... 450/75
6,627,562 B1 * 9/2003 Gehring, Jr. ..... 442/35
6,644,070 B2 * 11/2003 Ikenaga et al. ..... 66/196
6,779,369 B2 * 8/2004 Shepherd ..... 66/196
7,240,522 B2 * 7/2007 Kondou et al. ..... 66/195
7,611,999 B2 * 11/2009 McMurray ..... 442/304

OTHER PUBLICATIONS

Maidenform bra style 9439, Feb. 27, 2006 (earliest known publication date).

* cited by examiner

*Primary Examiner*—Gloria Hale
(74) *Attorney, Agent, or Firm*—Dickstein Shapiro LLP

(57) ABSTRACT

A bra includes first and second cups for contacting and supporting the breasts of a wearer of the bra, each cup having an inner side, located at a position between the breasts, and an outer side, located at an outer portion of each breast; and at least one bra wing extending from the outer side of each of the first and second cups. The at least one bra wing includes a spacer material having a modulus in at least one direction at 20% stretch and 10 lbs. load of between 1.27 and 2.13 lbs. of force.

14 Claims, 3 Drawing Sheets

PARAMETER TABLE:

DIRECTION :
TEMP/HUMIDITY:
CUSTOMER :
LOT/SO# :
PATTERN # :
COLOR # :
FABRIC STYLE # : PFP
NUMBER OF CONDITIONING CYCLES: 2
SPEED CONDITIONING CYCLES :800 mm/min
CYCLE SPEED :508 mm/min
MODULUS & LOAD INPUTS :1.) 10 lbf
1.) 20%, 2.) 40%, 3.) 60%

RESULTS:

| Nr | STRETCH % | MOD 1 lbf | MOD 2 lbf | MOD 3 lbf | RECOVERY % |
|---|---|---|---|---|---|
| 1 | 61.71 | 1.61 | 4.06 | 9.33 | 92.94 |
| 2 | 61.35 | 1.69 | 4.12 | 9.46 | 92.45 |
| 3 | 54.07 | 1.86 | 5.43 | | 85.57 |
| 4 | 53.27 | 1.87 | 5.56 | | 84.49 |

SERIES GRAPHICS:

BRA WINGS USING ELASTIC SPACER FABRIC

CROSS-REFERENCE TO RELATED APPLICATION

This application claims benefit of U.S. Provisional Application No. 60/913,381, filed Apr. 23, 2007, which is hereby incorporated by reference.

BACKGROUND

Brassiere or "bra" wings are the portions of a bra that wrap around the sides and back of the wearer of the bra. Because the wing portions of a bra cooperate with the cups and shoulder straps to support the breasts, elastic material has generally been used in making the wing portions.

One known way to provide this elasticity is to construct the bra wings from a multi-layer material, for example one having two smooth outer facing layers, and an elastic layer sandwiched therebetween. This method of construction has the advantage of including smooth outer fabrics for contacting the skin of the wearer. However, as a practical matter, straps with sandwiched elastic layers generally need to use additional "facing" elastics, i.e., thin strips of elastic sewn or laminated along the edges of the wings, to provide a sufficient amount of elasticity to perform the required support functions. This is because the amount and thickness of Elastane, or other elastic fibers, that would be needed to perform the function by means of the sandwiched elastic layer alone would cause the overall wing be too heavy and bulky.

However, facing elastics have a significant disadvantage in that they can lead to "back roll," the pinching of subcutaneous fat in the wearer's back between parallel strips of elastic. This can, in turn, lead to an unsightly result and embarrassment on the part of the wearer.

Another known way to provide the required elasticity in a bra wing is to make the bra wing from a foam material, such as the foam material used in bra cups. In this method, a foam layer is sandwiched, e.g., by lamination, between two layers of fabric. For example, known straps utilizing foam have been formed using a multi-layer structure having a first outer (top) facing layer of fabric material, a layer of glue, a sandwiched layer of foam, another layer of glue, and a second (bottom) outer facing layer of fabric material.

While foam supplies elasticity, it suffers from certain disadvantages. For one thing, foam tends to yellow with age if exposed. For this reason, the edges of any bra wing having a foam layer need to be sealed, for example using a sonic wheel. However, this seal tends to produce a rather sharp edge, which may cause discomfort, or at least the anticipation of discomfort on the part of the wearer.

Another disadvantage of the use of foam for forming the elastic layer of a bra strap is that foam does not exhibit an optimal modulus of elasticity, the ability of a material to snap back to its original size after being stretched, for retaining its shape over many wearer use cycles. Because of this characteristic of foam, a bra wing using foam would tend to stretch out over time.

SUMMARY OF THE INVENTION

A bra wing in accordance with one aspect of the present invention solves many problems of the prior art designs discussed above by utilizing a single layer of a type of fabric known as spacer fabric, in particular one having the desired elastic characteristics. A spacer fabric having a modulus of elasticity within a preferred ranged has been determined by the inventors to be particularly advantageous. Such a construction obviates the need for using a multi-layer construction and/or end facing elastic materials, as required in the prior art bra wing designs.

DESCRIPTION OF THE DISCLOSED EMBODIMENTS

Figure 1:
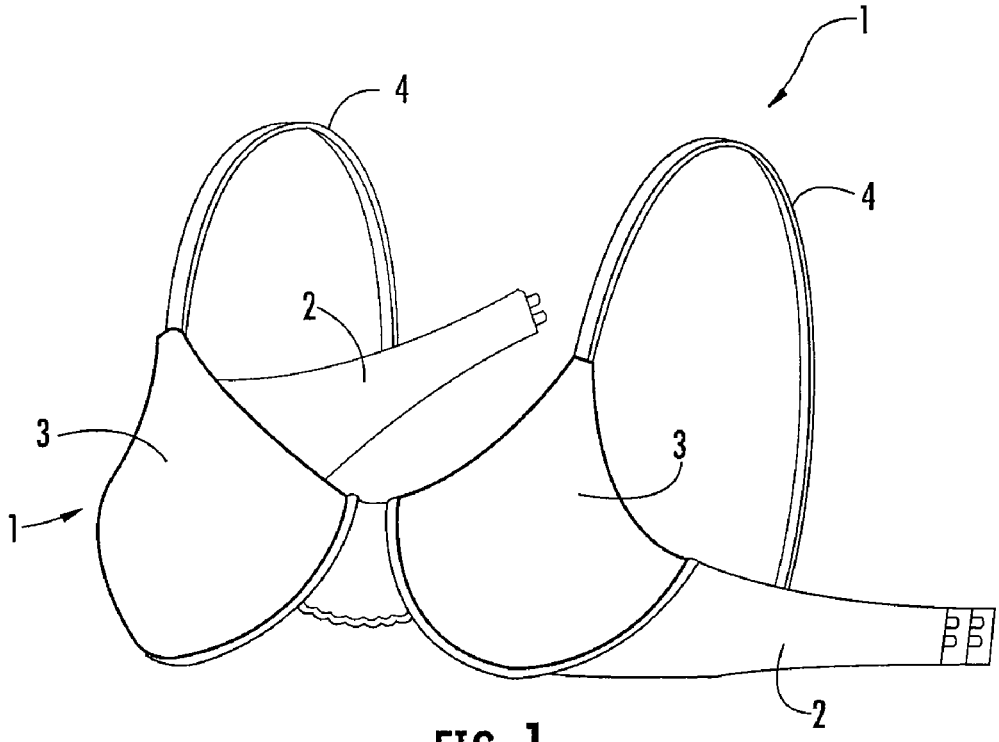
FIG. 1 is a diagram illustrating the structural components of a typical brassiere, or "bra;"

As illustrated in FIG. 1, in a brassiere or "bra" 1, bra wings 2 extend from the side of the cups 3 of the bra 1. Bra straps 4 are generally also provided to provide support by allowing the shoulders of the wearer to bear some of the weight of the breasts. When the bra is closed, the bra wings 2 provide support by squeezing the sides of the wearer. Because the bra wings 2 squeeze the sides and back of the wearer, it is highly desirable that the wings remain comfortable throughout the life of the garment, while maintaining their support characteristics.

Because the bra shown in the figure snaps in the back, two separate wings are used. However, as will be understood by those skilled in the art, a bra may also open in the front between the cups. In such a case, a single unitary wing is provided that extends from the sides of the cups and around the sides and back of the user. The present invention also applies to such unitary bra wings and bras incorporating such wings.

Figure 2:
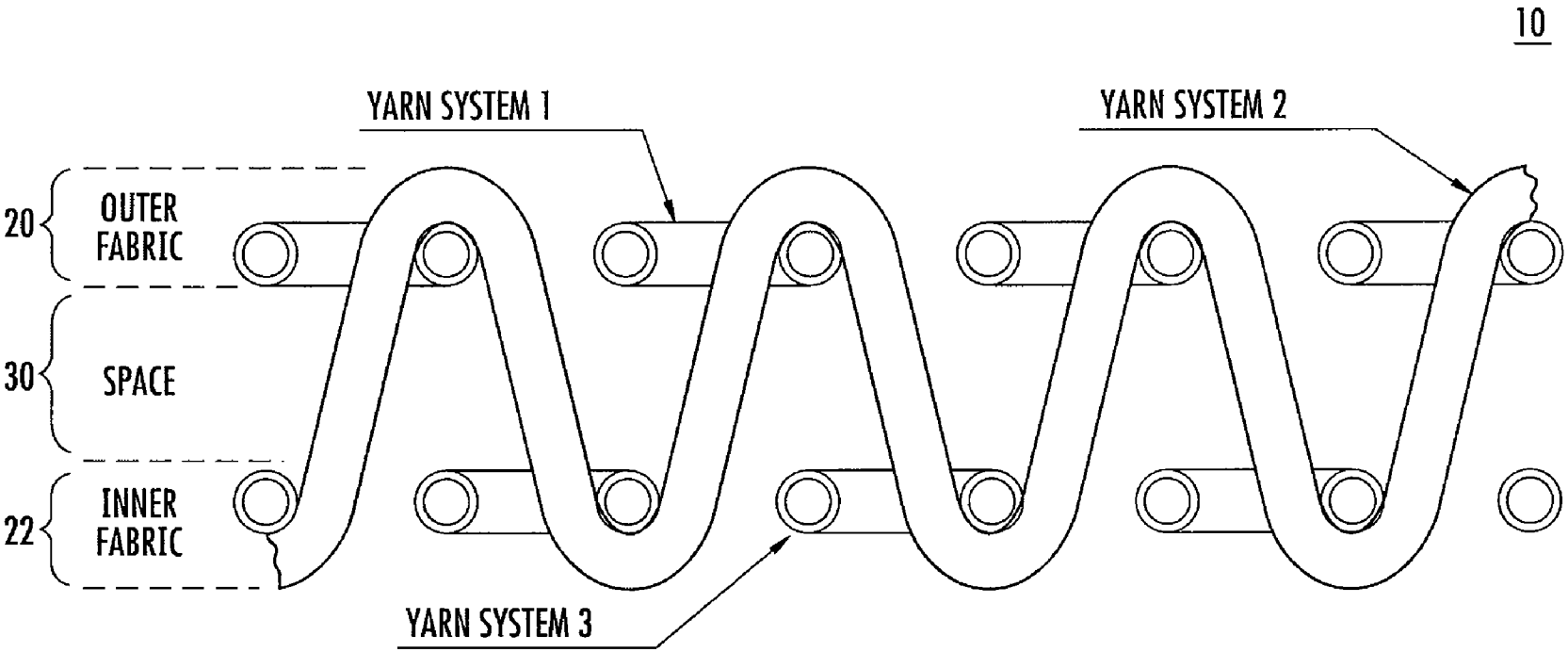
FIG. 2 is a cross-sectional diagram of the construction of a spacer fabric suitable for use in making bra wings in accordance with the present invention.

FIG. 2 is a simplified cross-sectional diagram showing the structure of a spacer fabric 10 as used in bra wings formed in accordance with the present invention. Spacer fabrics consist of two complementary slabs of fabric forming the outer layer 20 and inner layer 22, with a third layer, forming a spacing 30, knit between them.

In a spacer fabric, the spacing layer 30, consisting in the illustrated example of yarn system 2, is interknit with the outer layer 20, formed of yarn system 1, and inner fabric layer 22, formed of yarn system 3, to form an overall spacer fabric 10. The knitting of the spacing layer 30 with the inner and outer layers interlocks the inner and outer layers. At the same time, depending on the stiffness of the fibers of the third layer, the interlocking maintains a spacing between the inner and outer layers.

The inventors of the present invention have found through experimentation that a spacer fabric having certain physical characteristics is particularly advantageous in forming bra wings. The inventors have found that by using spacer fabric having a particular range of modulus characteristics results in a particularly excellent bra wing material providing both comfort and support for the wearer.

The inventors have found that in a spacer fabric for bra wings it is most preferred to use spacing fabric having a circular double knit (interlock) spacer construction, and preferably made on a 28 gauge double knitting machine. The inventors also found that is most preferable, for the outer and inner fabric layers 20 and 22 (yarn systems 1 and 3), to use 78 dtex/68 filament Nylon and 70 denier Spandex. The spacing layer 30 (yarn system 2) is preferably formed from 30 denier/10 filament nylon. The stiffness of the yarn used in the spacing layer 30 will result in a spacing apart of the inner and outer layers, and will therefore provide a cushioning effect due to this spacing. An example of a preferred spacer fabric exhibiting the foregoing characteristics is Pacific Textiles Article TD0258S, available from Pacific Textiles, which has a fiber content of about 75% nylon and 25% Spandex.

The inventors have found particularly excellent results in making bra wings from a spacer fabric material that exhibits the following characteristics.

With respect to weight, the spacer fabric should preferably have a weight in the range of 11.88 to 13.12 oz/yd$^2$, and most preferably a weight of about 12.50 oz/yd$^2$. With respect to shrinkage, the spacer fabric should exhibit shrinkage in the length direction of in the range of 0%-5% in both the length and width directions, and more preferably a shrinkage of about 5%.

The construction of the spacer fabric preferably should be in the range of 43-47 Wales per inch, and more preferably about 45 Wales per inch. The construction preferably should be in the range of 78-86 Coarses per inch, and most preferably about 82 Coarses per inch.

The Elongation and Modulus characteristics are discussed as follows in connection with tests performed under a test method derived from ASTM D4964. In this method readings are taken on a third cycle outgoing curve Zwick tester-CRE (Constant Range of Extension). In the measurement for Modulus and Elongation, an effective load of 10 lbs. is used. Under such test conditions it was found preferable for the Elongation of the spacer fabric in the length direction to fall in the range of 51-71%, and most preferably about 61%. In the width direction, it was found preferable for the Elongation of the spacer fabric to fall in the range of 43-63%, and most preferably about 53%.

The spacer fabric of the present invention preferably exhibits a modulus in the length direction in a range of, at 20% stretch in the outgoing curve, 1.27-2.13 lbs of force (lbf), and most preferably about 1.7 lbf, and at 40% stretch in the outgoing curve, in a range of 3.11-5.19 lbf and most preferably about 4.15 lbf. In the width direction, the spacer fabric preferably exhibits a modulus in a range of, at 20% stretch in the outgoing curve, 1.42-2.38 lbs of force (lbf), and most preferably about 1.9 lbf.

Test results of an actual sample of spacer fabric suitable for use in the present invention are discussed with reference to FIG. 3. The test is performed under the same test method as discussed above.

Figure 3:
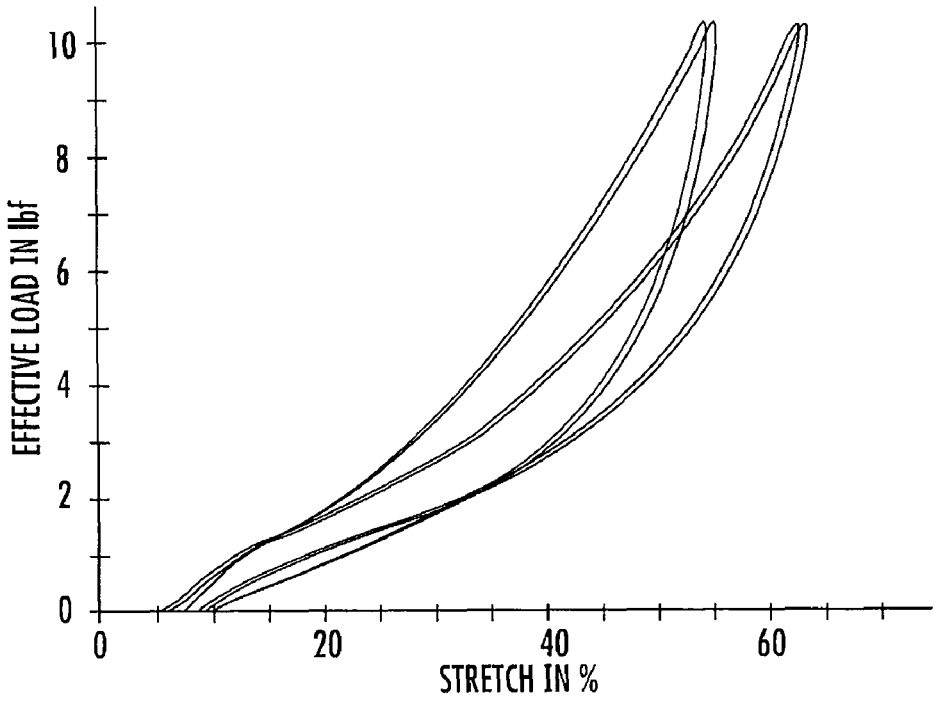
FIG. 3 includes tables and a graph showing test results of a spacer fabric of a type suitable for use in making bra wings in accordance with the present invention.

As can be seen from the Parameter Table of FIG. 3, two conditioning cycles were performed before the actual test results were collected. The testing was performed with a 10 lb. test force and the modulus was tested at stretch percentages of 20%, 40% and, in the length direction, 60%. After the conditioning cycles, each test (length and width) was performed and measured twice.

Test numbers 1 and 2 in the Results table represent two tests performed in the length direction. Test numbers 3 and 4 represent two tests performed in the width direction. As can be seen from the Results Table of FIG. 3, the results of both tests in the length direction, test numbers 1 and 2, fell within the desired range for the Mod 1 test at 20% stretch outgoing (1.61 and 1.69 lbf.) and at the Mod 2 test at 40% stretch outgoing (4.06 and 4.12 lbf.). Likewise the Elongation results in the length direction of about 62% and 61% fall within the preferred range discussed above.

Tests 3 and 4 of the Results table show results for Elongation and Modulus for the width direction, each falling within the preferred range as measured on the outgoing curve. The graph at the bottom of FIG. 3 is a graph plot of the test results listed in the Results table, with the top of each curve indicating the outgoing curve and the bottom of each line indicating the return or incoming curve.

A spacer fabric having characteristics in the range discussed in the foregoing paragraphs has been found by the inventors to provide particularly excellent results for use as bra wings, both in terms of comfort and performance.

Formation of bra wings in accordance with the present invention from the spacer fabric discussed above requires cutting the spacer fabric into the desired shape, the shape depending upon whether dual or unitary wings are used. The preferred shapes are well-known, although they may vary somewhat depending upon the overall design of the bra comprising the wings. Methods for sewing or otherwise affixing the edges of the wings to the bra cup area of the bra are well-known in the art and need not be discussed in detail.

Spacer fabrics exhibit a tendency to fray at a cut edge by the nature of their construction. In order to minimize fraying at the edges in forming the bra wings, the inventors have found that it is preferable in shaping the bra wings from the preferred spacer fabric to use a knife to cut the material, making a directional cut, rather than a punch and die method of punching out the shape. The use of a die to cut spacer fabrics, and particular spacer fabrics with the preferred characteristics, will lead to the occurrence of in inordinate amount of fraying. On the other hand, the inventors have found that a cutting method using a knife for a directional cut provides for a highly satisfactory edge with very little fraying.

The present invention allows for the construction of bra wings that are comfortable and yet still provide support over many wearer use cycles, and bras comprising such bra wings.

What is claimed is:

1. A bra comprising:

first and second cups for contacting and supporting the breasts of a wearer of the bra, each cup having an inner side, located at a position between the breasts, and an outer side, located at an outer portion of each breast; and at least one bra wing extending from the outer side of each of the first and second cups, the at least one bra wing comprising a spacer material having a modulus of elasticity in at least one direction at 20% stretch and 10 lbs. load of between 1.27 and 2.13 lbs. of force and an elongation in the length direction of between 51% to 71%, wherein the spacer material comprises:

an outer fabric comprising a first yarn; and an inner fabric, the inner fabric being spaced apart from the outer fabric by a second yarn that is knit with both the outer fabric and the inner fabric so as to maintain a spacing therebetween, the inner fabric comprising a third yarn.

2. A bra according to claim 1, wherein the spacer material has a circular double knit interlock spacer construction.

3. A bra according to claim 1, wherein the first and third yarns of the spacer material comprise 78 dtex/68 filament Nylon and 70 denier Spandex and the second yarn of the spacer material comprises 30 denier/10 filament nylon.

4. A bra according to claim 1, wherein the spacer material has a fiber content of about 75% nylon and 25% Spandex.

5. A bra according to claim 1, wherein the spacer material exhibits a modulus of elasticity in the length direction in a range of, at 20% stretch in the outgoing curve, 1.27-2.13 lbs of force (lbf), and at 40% stretch in the outgoing curve, in a range of 3.11-5.19 lbf, and in the width direction, the spacer fabric preferably exhibits a modulus of elasticity in a range of, at 20% stretch in the outgoing curve, 1.42-2.38 lbs of force (lbf).

6. A bra according to claim 1, wherein the spacer material has a weight in the range of 11.88 to 13.12 oz/yd$^2$.

7. A bra according to claim 1, wherein the spacer material construction is in the range of 43-47 Wales per inch and in the range of 78-86 Coarses per inch.

8. A bra wing comprising:

a spacer material having a modulus of elasticity in at least one direction at 20% stretch and 10 lbs. load of between 1.27 and 2.13 lbs. of force and an elongation in the length direction of between 51% to 71%, wherein the spacer material comprises:

an outer fabric comprising a first yarn; and an inner fabric, the inner fabric being spaced apart from the outer fabric by a second yarn that is knit with both the outer fabric and the inner fabric so as to maintain a spacing therebetween, the inner fabric comprising a third yarn.

9. A bra wing according to claim 8, wherein the spacer material has a circular double knit interlock spacer construction.

10. A bra wing according to claim 8, wherein the first and third yarns of the spacer material comprise 78 dtex/68 filament Nylon and 70 denier Spandex and the second yarn of the spacer material comprises 30 denier/10 filament nylon.

11. A bra wing according to claim 8, wherein the spacer material has a fiber content of about 75% nylon and 25% Spandex.

12. A bra wing according to claim 8, wherein the spacer material exhibits a modulus of elasticity in the length direction in a range of, at 20% stretch in the outgoing curve, 1.27-2.13 lbs of force (lbf), and at 40% stretch in the outgoing curve, in a range of 3.11-5.19lbf, and in the width direction, the spacer fabric preferably exhibits a modulus of elasticity in a range of, at 20% stretch in the outgoing curve, 1.42-2.38 lbs of force (lbf).

13. A bra wing according to claim 8, wherein the spacer material has a weight in the range of 11.88 to 13.12 oz/yd$^2$.

14. A bra wing according to claim 8, wherein the spacer material construction is in the range of 43-47 Wales per inch and in the range of 78-86 Coarses per inch.

* * * * *